US007607749B2

(12) United States Patent
Tabata et al.

(10) Patent No.: US 7,607,749 B2
(45) Date of Patent: Oct. 27, 2009

(54) PRINTER

(75) Inventors: Kunio Tabata, Shiojiri (JP); Toshiyuki Suzuki, Shiojiri (JP); Atsushi Oshima, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 92 days.

(21) Appl. No.: 12/053,146

(22) Filed: Mar. 21, 2008

(65) Prior Publication Data

US 2008/0231648 A1 Sep. 25, 2008

(30) Foreign Application Priority Data

Mar. 23, 2007 (JP) ..... 2007-076144

(51) Int. Cl.
*B41J 29/38* (2006.01)

(52) U.S. Cl. ..... 347/14; 347/19; 347/116

(58) Field of Classification Search ..... 347/14, 347/19, 101, 116
See application file for complete search history.

(56) References Cited

U.S. PATENT DOCUMENTS

2008/0186350 A1* 8/2008 Oshima et al. ..... 347/16

FOREIGN PATENT DOCUMENTS

JP 11-245383 9/1999
JP 2005-075475 3/2005

* cited by examiner

*Primary Examiner*—Thinh H Nguyen
(74) *Attorney, Agent, or Firm*—Workman Nydegger

(57) ABSTRACT

A printer includes a first transporting belt that transports a print medium and a second transporting belt that receives the print medium from the first transporting belt and further transports the print medium. A liquid ejection head ejects liquid according to a liquid-ejection timing signal to the print medium transported by the first transporting belt and the second transporting belt. A signal generator outputs the liquid-ejection timing signal according to a first signal and a second signal that correspond to the travel of the first and second transporting belts, respectively. When the phase difference between the first and second signals has a predetermined threshold value or less, the signal generator switches from outputting the liquid-ejection timing signal according to the first signal to outputting the liquid-ejection timing signal according to the second signal.

2 Claims, 7 Drawing Sheets

PRINTER

BACKGROUND

1. Technical Field

The present invention relates to printers that print predetermined characters or images by ejecting liquid from multiple nozzles to form fine particles thereof (dots) onto a print medium.

2. Related Art

Ink jet printers, one of such printers, print predetermined characters or images onto a print medium to produce desired prints by discharging (ejecting) liquid (ink drops) from the nozzles of a liquid ejection head (also referred to as an ink jet head) to form fine ink dots onto the print medium while relatively moving the print medium and the ink jet head. Among them, printers that move an ink jet head placed on a moving body, called a carriage, in the direction intersecting the direction of transportation of print media are generally referred to as multipass ink jet printers. On the other hand, printers capable of so-called one-pass printing with an ink jet head that is long in the direction intersecting the direction of transportation of print media (which may not be of an integral type) are generally referred to as line-head ink jet printers.

Some of these ink jet printers perform printing by applying electrical charge to, for example, a transporting belt, to charge it, transporting a substantially insulating print medium electrostatically adsorbed to the transporting belt, and ejecting ink drops from an ink jet head onto the print medium transported. Another printer transports a print medium adsorbed on a transporting belt by negative air pressure. Such print-medium transporting methods are useful particularly for line-head ink jet printers. An example of liquid-ejection timing signals (ink-drop-ejection timing signals) is a pulse signal output from a linear encoder disposed on a transporting belt, as described in JP-A-11-245383. The printer ejects ink drops in synchronism with such a pulse signal output from the linear encoder.

An ink jet printer described in JP-A-2005-75475 has two line-head ink jet heads at upstream and downstream portions of the transportation of print media and two sets of transporting units corresponding to the ink jet heads in the direction of transportation of print media, the transporting units each having a plurality of transporting belts disposed at predetermined intervals in the direction intersecting the direction of transportation of print media. This printer performs printing by transporting a print medium that is electrostatically adsorbed on the transporting belts, and ejecting ink drops onto the transported print medium from the upstream and downstream ink jet heads. The ink jet heads are disposed between the transporting belts. The troubles of the nozzles of the ink jet heads are resolved, that is, the nozzles are cleaned using a cleaning unit disposed directly under the ink jet heads.

In the case of printers having a plurality of ink jet heads along the direction of transportation of print media and a plurality of transporting units corresponding to the ink jet heads, the transporting units each having two or more transporting belts in the direction of transportation of print media, as described in JP-A-2005-75475, for correct control of liquid ejection (ink-drop discharge) timing, it is desirable that each of the transporting units have a linear encoder and a liquid-ejection timing signal (ink-drop-discharge timing signal) be output in response to the signal output from a corresponding linear encoder. However, for example, even if a linear encoder with an output signal pitch (cycle) corresponding to the print resolution is mounted on each of the transporting units disposed in direction of transportation of print media, and linear-encoder output signals are switched as a liquid-ejection timing signal (ink-drop-discharge timing signal) in accordance with the timing at which a print medium is transferred from the upstream transporting unit to the downstream transporting unit, the timing of liquid ejection (ink-drop discharge) is shifted at the position of the switching. Accordingly, the liquid cannot be ejected (dots cannot be formed) in correct positions, resulting in a decrease in print quality.

SUMMARY

An advantage of some aspects of the invention is to provide a printer having two or more transporting units in the direction of transportation of print media can print high-quality images.

A printer according to an aspect of the invention includes: a first transporting belt that transports a print medium; a second transporting belt that receives the print medium from the first transporting belt and further transports the print medium; a first linear encoder that outputs a first signal corresponding to the travel of the first transporting belt; a second linear encoder that outputs a second signal corresponding to the travel of the second transporting belt; a liquid ejection head that ejects liquid according to a liquid-ejection timing signal to the print medium transported by the first transporting belt and the second transporting belt; and a signal generator that outputs the liquid-ejection timing signal according to one of the first signal and the second signal. When the phase difference between the first signal and the second signal is a predetermined threshold value or less in transferring the print medium 1 from the first transporting belt to the second transporting belt, the signal generator switches from outputting the liquid-ejection timing signal according to the first signal to outputting the liquid-ejection timing signal according to the second signal.

This structure can decrease the displacement of the dots during the switching of the linear encoders, thus providing high-quality print images.

In this case, it is preferable that when the phase difference between the first signal and the second signal is larger than the predetermined threshold value after a predetermined period of time has elapsed from the time where the print medium is transported to a designated position of the second transporting belt, the signal generator increase the predetermined threshold value.

This structure can hold the predetermined value of the phase difference between the linear encoders small until a designated time passes. This structure can therefore decrease the displacement of the dots as much as possible during the switching of the linear encoders, thus providing high-quality print images.

BRIEF DESCRIPTION OF THE DRAWINGS

The invention will be described with reference to the accompanying drawings, wherein like numbers reference like elements.

DESCRIPTION OF EXEMPLARY EMBODIMENTS

As an example of the printer of the invention, an ink jet printer according to an embodiment for printing characters or images on a print medium by ejecting ink will be described with reference to the drawings.

Figure 1A:
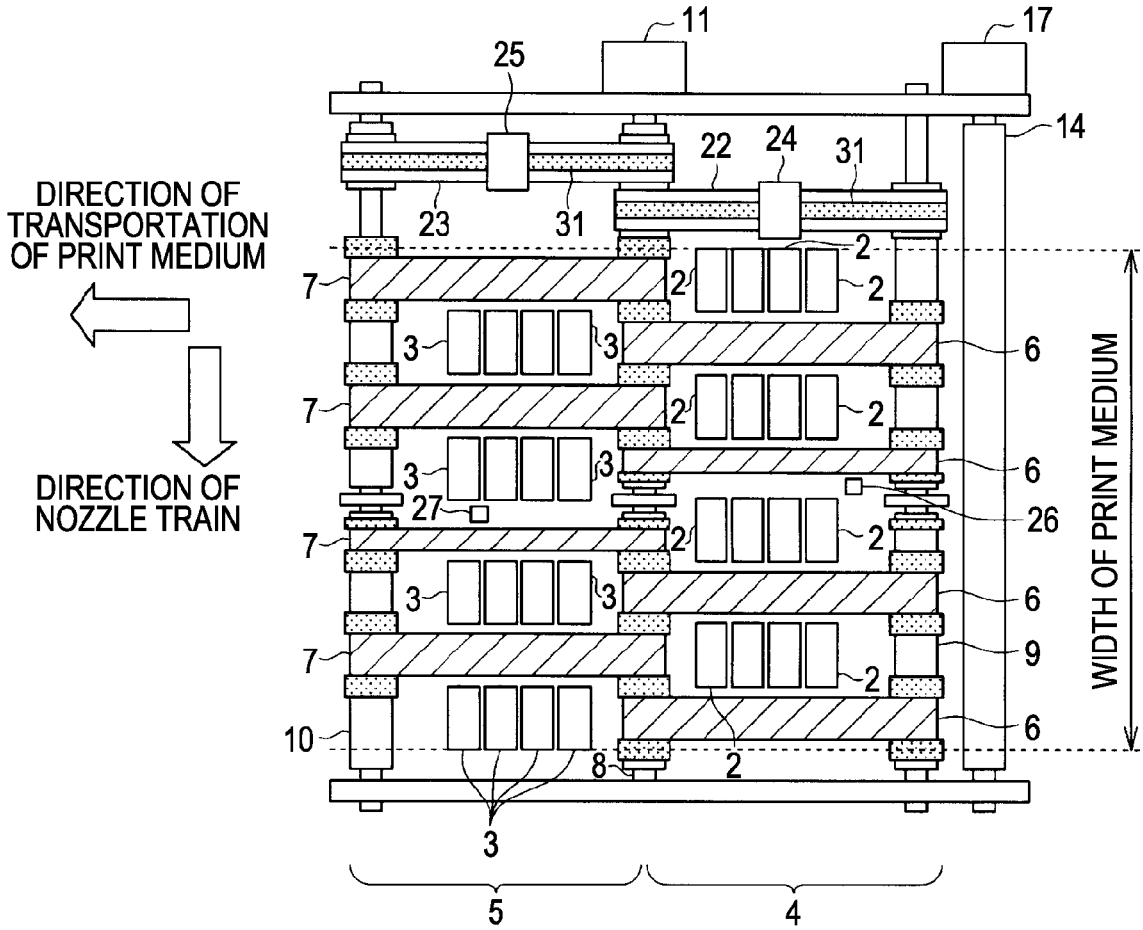
FIG. 1A is a schematic plan view of a line-head ink jet printer according to an embodiment of the invention.
Figure 1B:
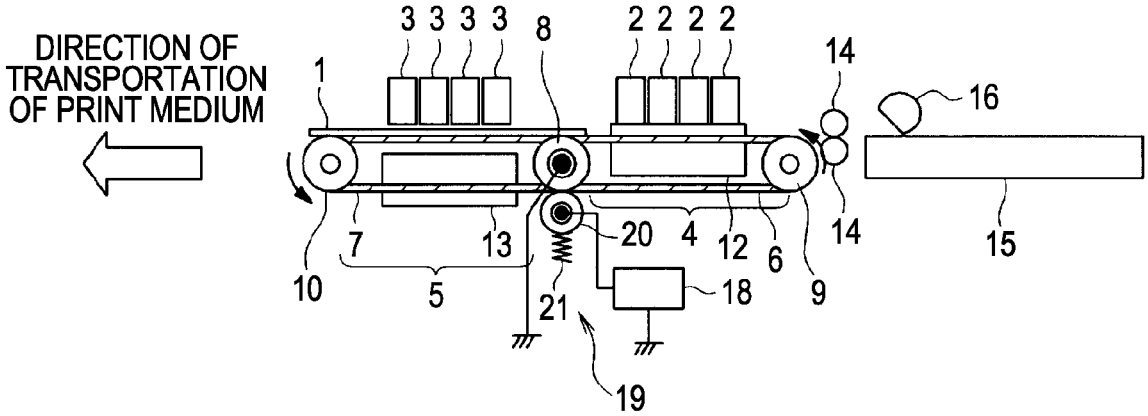
FIG. 1B is a side view of the ink jet printer.

FIGS. 1A and 1B are schematic diagrams of the ink jet printer of this embodiment: FIG. 1A is a plan view thereof; and FIG. 1B is a side view thereof. The printer shown in FIGS. 1A and 1B is a line-head ink jet printer in which a print medium 1 is transported from the right to the left along the arrow, and is printed in a printing region midway through transportation. This embodiment has the ink jet head not only at one place but at two places.

Reference numeral 2 denotes a first ink jet head disposed upstream in the direction of transportation of the print medium 1, and reference numeral 3 denotes a second ink jet head disposed downstream of the transportation. A first transporting section 4 for transporting the print medium 1 is disposed below the first ink jet heads 2. A second transporting section 5 is disposed below the second ink jet heads 3. The first transporting section 4 includes four first transporting belts 6 disposed at predetermined intervals in the direction intersecting the direction of transportation of the print medium 1 (hereinafter, also referred to as the direction of the nozzle train). Likewise, the second transporting section 5 includes four second transporting belts 7 disposed at predetermined intervals in the direction intersecting the direction of transportation of the print medium 1 (in the direction of the nozzle train).

The four first transporting belts 6 and the four second transporting belts 7 are alternately disposed next to each other. The overlapping section between the first transporting belts 6 and the second transporting belts 7 has a driving roller 8, upstream of which a first driven roller 9 is disposed, and downstream of which a second driven roller 10 is disposed. The first transporting belts 6 are wound around the driving roller 8 and the first driven roller 9. The second transporting belts 7 are wound around the driving roller 8 and the second driven roller 10. The driving roller 8 connects to an electric motor 11. Accordingly, when the driving roller 8 is rotated by the electric motor 11, the first transporting section 4 constituted by the first transporting belts 6 and the second transporting section 5 constituted by the second transporting belts 7 are moved in synchronism at the same speed.

In this embodiment, at the uppermost part of FIG. 1A, a first linear encoder belt 22 for detecting the state of the travel of the first transporting belts 6 is wound around the driving roller 8 and the first driven roller 9 and a second linear encoder belt 23 for detecting the state of the travel of the second transporting belts 7 is wound around the driving roller 8 and the second driven roller 10. The first linear encoder belt 22 and the second linear encoder belt 23 each have, around the outer surfaces, a series of magnetic layer 31, on which magnetic polarity that is reversed at a predetermined cycle (pitch) is recorded, for example. The records are detected by a first linear encoder sensor 24 and a second linear encoder sensor 25. The records on the linear encoder belts 22 and 23 will be described in detail later. A combination of the first linear encoder belt 22 and the first linear encoder sensor 24 constitutes a linear encoder disposed in the transporting unit upstream in the direction of transportation of print media, that is, an upstream linear encoder. A combination of the second linear encoder belt 23 and the second linear encoder sensor 25 constitutes a linear encoder disposed in the transporting unit downstream in the direction of transportation of print media, that is, a downstream linear encoder.

A first print-medium detection sensor 26 for detecting the presence or absence of the print medium 1 is disposed upstream from the first ink jet heads 2 in the direction of transportation of print media. A second print-medium detection sensor 27 is disposed in the vicinity of the second ink jet heads 3. The print-medium detection sensors 26 and 27 are, for example, optical sensors, which output a high-level signal when the print medium 1 is present on the sensors, and output a low-level signal when no print medium is present. The second print-medium detection sensor 27 is disposed in the position at which it outputs a high-level signal when the print medium 1 placed on the first transporting belts 6 of the first transporting section 4 and the second transporting belts 7 of the second transporting section 5 evenly or substantially evenly.

The first ink jet heads 2 and the second ink jet heads 3 are shifted in the direction of transportation of the print medium 1 for each of, for example, four colors, yellow (Y), magenta (M), cyan (C), and black (K). The ink jet heads 2 and 3 are supplied with inks from ink tanks of the respective colors (not shown) through ink feed tubes. The ink jet heads 2 and 3 each have multiple nozzles in the direction intersecting the direction of transportation of the print medium 1 (that is, in the direction of the nozzle train), from which a necessary amount of ink drops is ejected onto necessary portions at the same time to form fine ink dots on the print medium 1. This is executed for each color so that so-called one-pass printing can be carried out only by passing the print medium 1 transported by the first transporting section 4 and the second transporting section 5 one time. That is, the region where the ink jet heads 2 and 3 are disposed corresponds to a printing region.

Examples of methods for discharging ink from the nozzles of the ink jet heads include an electrostatic method, a piezoelectric method, and a film-boiling ink jet method. The electrostatic method is one in which when an electrostatic gap serving as an actuator is given a driving signal, the diaphragm in the cavity is displaced to change the pressure in the cavity, so that ink drops are discharged from the nozzles. The piezoelectric method is one in which when a piezoelectric element serving as an actuator is given a driving signal, the diaphragm in the cavity is displaced to change the pressure in the cavity, so that ink drops are discharged from the nozzles. The film-boiling ink jet method is one in which a small heater provided in the cavity heats ink instantly to 300° C. or more to cause film boiling to generate bubbles, which causes changes in pressure, so that ink drops are discharged from the nozzles. The invention can be applied to any of the ink discharge methods.

The ink-drop ejection nozzles of the first ink jet heads 2 are provided only between the four first transporting belts 6 of the first transporting section 4. The ink-drop ejection nozzles of the second ink jet heads 3 are provided only between the four second transporting belts 7 of the second transporting section 5. This is for the purpose of cleaning the ink jet heads 2 and 3 with cleaning sections, to be described later. However, this arrangement precludes one-pass full-page printing only with one of the ink jet heads 2 and 3. Accordingly, the first ink jet heads 2 and the second ink jet heads 3 are shifted in the direction of transportation of the print medium 1 to make up for their unprintable areas.

First cleaning caps 12 for cleaning the first ink jet heads 2 are disposed below the first ink jet heads 2. Second cleaning caps 13 for cleaning the second ink jet heads 3 are disposed below the second ink jet heads 3. The cleaning caps 12 and 13 have such a size as to pass between the four first transporting belts 6 of the first transporting section 4 and between the four second transporting belts 7 of the second transporting section 5, respectively. These cleaning caps 12 and 13 each include a cap body with a rectangular bottom that can cover the nozzles in the lower surface, that is, the nozzle surfaces of the ink jet heads 2 and 3 and can come into close contact with the nozzle surfaces, an ink absorber disposed on the bottom, a tube pump connected to the bottom of the cap body, and an elevator that moves the cap body up and down. The cap bodies are moved upward by the elevators into close contact with the nozzle surfaces of the ink jet heads 2 and 3, and in that state, the interior of the cap bodies is brought to negative pressure by the tube pumps. Then, ink drops and bubbles are sucked from the nozzles open in the nozzle surfaces of the ink jet heads 2 and 3, so that the ink jet heads 2 and 3 are cleaned. After completion of the cleaning, the cleaning caps 12 and 13 are moved downward.

A pair of gate rollers 14 for controlling the timing to feed the print medium 1 from a paper feed section 15 and for correcting the skew of the print medium 1 is provided upstream from the first driven roller 9. The skew is the distortion of the print medium 1 with respect to the direction of transportation. A pickup roller 16 for feeding the print medium 1 is disposed on the paper feed section 15. Numeral 17 in FIG. 1A denotes a gate roller motor for driving the gate rollers 14.

A belt charging unit 19 is disposed under the driving roller 8. The belt charging unit 19 includes a charging roller 20 that is in contact with the first transporting belts 6 and the second transporting belts 7 while holding the driving roller 8 therebetween, a spring 21 that pushes the charging roller 20 against the first transporting belts 6 and the second transporting belts 7, and a power supply 18 that applies electric charge to the charging roller 20. The belt charging unit 19 applies electric charge from the charging roller 20 to the first transporting belts 6 and the second transporting belts 7 to charge them. Such belts are generally made of a middle- or high-resistance material or an insulating material. Accordingly, when the first transporting belts 6 and the second transporting belts 7 are charged by the belt charging unit 19, the electric charge applied to the surfaces causes dielectric polarization in the print medium 1, which is also made of a high-resistance material or an insulating material, so that static electricity is generated between the electric charge due to the dielectric polarization and the electric charge on the surfaces of the belts 6 and 7. This static electricity acts to adsorb the print medium 1 to the belts 6 and 7. The belt charging unit 19 may be of a corotron type using non-contact charging.

Thus, this ink jet printer operates in such a manner that the surfaces of the first transporting belts 6 and the second transporting belts 7 are charged by the belt charging unit 19, in which state the print medium 1 is fed through the gate rollers 14; when the print medium 1 is pushed against the first transporting belts 6 by a bail roller formed of a spur and a roller (not shown), the print medium 1 is adsorbed on the surfaces of the first transporting belts 6 by the action of the dielectric polarization; and when the driving roller 8 is rotated by the electric motor 11 in that state, its rotating force is transmitted to the first driven roller 9 through the first transporting belts 6.

The first transporting belts 6, with the print medium 1 electrostatically adsorbed thereto, are moved downstream in the direction of transportation to move the print medium 1 to below the first ink jet heads 2, and ink drops are ejected from the nozzles of the first ink jet heads 2 to perform printing. After completion of the printing by the first ink jet heads 2, the print medium 1 is moved downstream in the direction of transportation and transferred onto the second transporting belts 7 of the second transporting section 5. As described above, the surfaces of the second transporting belts 7 are also charged by the belt charging unit 19, so that the print medium 1 is adsorbed on the surfaces of the second transporting belts 7 by the action of the dielectric polarization.

In this state, the second transporting belts 7 are moved downstream in the direction of transportation to move the print medium 1 to below the second ink jet heads 3, and ink drops are ejected from the nozzles of the second ink jet heads 3 to perform printing. After completion of the printing by the second ink jet heads 3, the print medium 1 is further moved downstream in the direction of transportation, and ejected onto an output section while being separated from the surfaces of the second transporting belts 7 by a separating unit (not shown).

When the first and second ink jet heads 2 and 3 need cleaning, the first and second cleaning caps 12 and 13 are moved upward so that the cap bodies are brought into close contact with the nozzle surfaces of the first and second ink jet heads 2 and 3, in which state the interior of the cap bodies are brought to negative pressure, so that ink drops and bubbles are absorbed through the nozzles of the first and second ink jet heads 2 and 3 to clean them, and thereafter the first and second cleaning caps 12 and 13 are moved downward, as described above.

Figure 2:
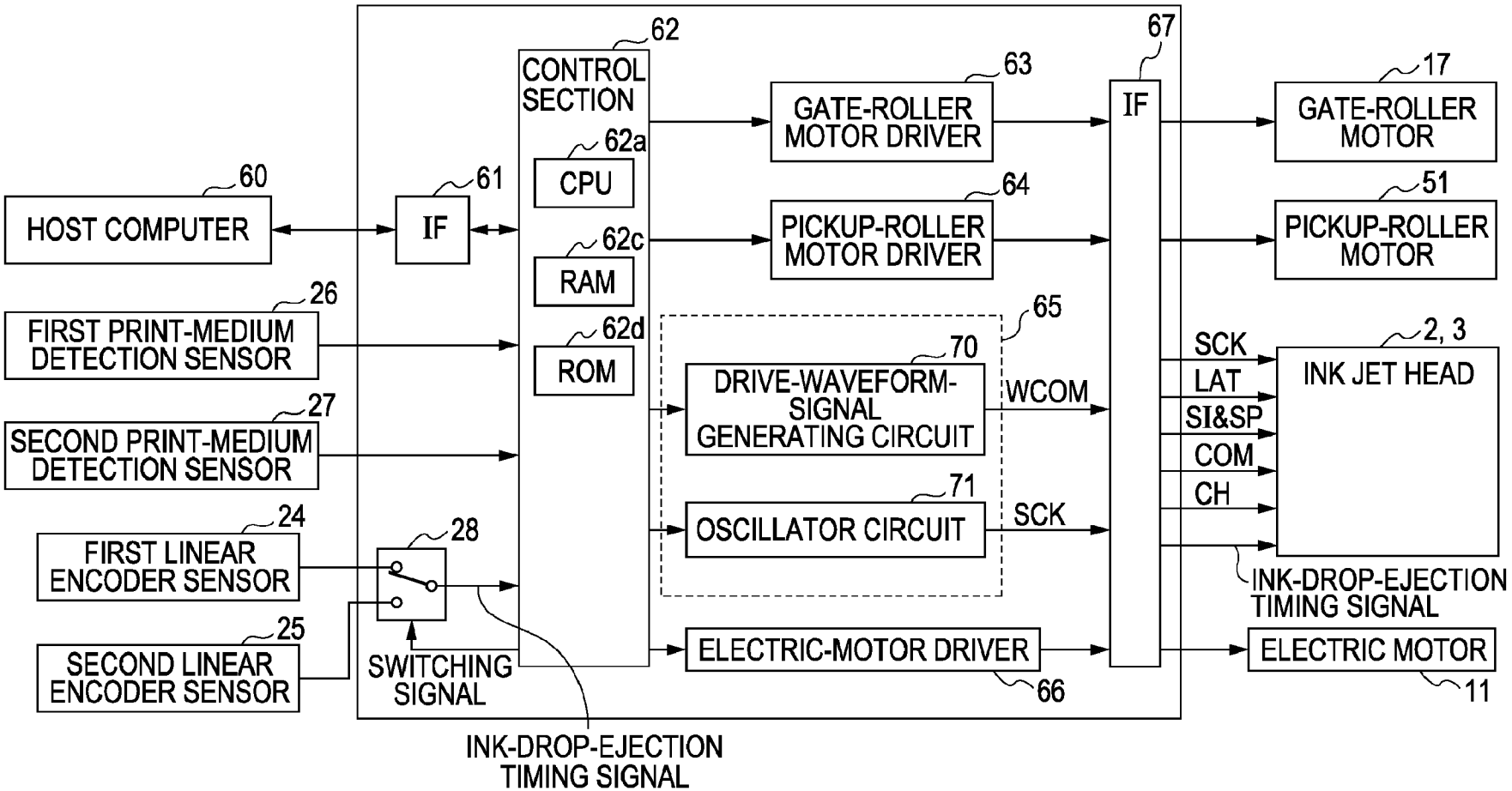
FIG. 2 is a block diagram of a control unit of the ink jet printer of FIG. 1.

The ink jet printer of this embodiment is provided with a control unit for controlling the printer. As shown in FIG. 2, this control unit controls the printer, the paper feeding unit and so on according to print data input from a host computer 60 of, for example, a personal computer or a digital camera to print on a print medium. The control unit includes an input interface 61 for receiving print date input from the host computer 60 and signals output from the first linear encoder sensor 24, the second linear encoder sensor 25, the first print-medium detection sensor 26, and the second print-medium detection sensor 27; a control section 62 constituted by, for example, a microcomputer, for performing printing according to print data input from the input interface 61; a gate-roller motor driver 63 that drives the gate roller motor 17; a pickup-roller motor driver 64 that drives a pickup roller motor 51 for driving the pickup roller 16; a head driver 65 that drives the ink jet heads 2 and 3; an electric-motor driver 66 that drives the electric motor 11; and an interface 67 that converts the signals output from the drivers 63 to 66 to driving signals for use in the external gate roller motor 17, pickup roller motor 51, ink jet heads 2 and 3, and electric motor 11 and outputs them.

The control section 62 has a central processing unit (CPU) 62*a* that executes various processing including printing, a random access memory (RAM) 62*c* that temporarily stores print data that is input via the input interface 61 and various data for printing the print data or temporarily decompresses application programs for printing and so on, and a read-only memory (ROM) 62*d* or a nonvolatile semiconductor memory that stores control programs to be executed by the CPU 62*a*. The control section 62 operates in such a manner that when print data (image data) is sent from the host computer 60 via the input interface 61, the CPU 62*a* processes this print data to output print data (driving-signal selection data signal SI & SP) indicative of which nozzle is to be used to eject ink drops or how much ink drops is to be ejected, and outputs control signals to the drivers 63 to 66 according to this print data and input data from the sensors. The control signals output from the drivers 63 to 66 are converted to driving signals by the interface 67, by which actuators corresponding to the nozzles of the ink jet heads, the gate roller motor 17, the pickup roller motor 51, and the electric motor 11 are driven, so that the feeding, transportation, position control, and printing of the print medium 1 are executed. The head driver 65 includes a drive-waveform-signal generating circuit 70 that generates a drive waveform signal WCOM and an oscillator circuit 71 that generates a clock signal SCK.

The ink jet heads 2 and 3 are fed a driving signal COM obtained by amplifying the drive waveform signal WCOM by the interface 67, the driving-signal selection data signal SI & SP for selecting nozzles to eject ink drops according to print data and determining the timing to connect actuators, such as piezoelectric elements, to the driving signal COM, a latch signal LAT and a channel signal CH for connecting the driving signal COM with the actuators of the ink jet heads 2 and 3 according to the driving-signal selection data signal SI & SP after nozzle selection data is input to all the nozzles, the clock signal SCK for serially transmitting the driving-signal selection data signal SI & SP to the ink jet heads 2 and 3, and an ink-drop-ejection timing signal for ejecting ink drops on the rising edge of a pulse, to be described later.

Figure 3:
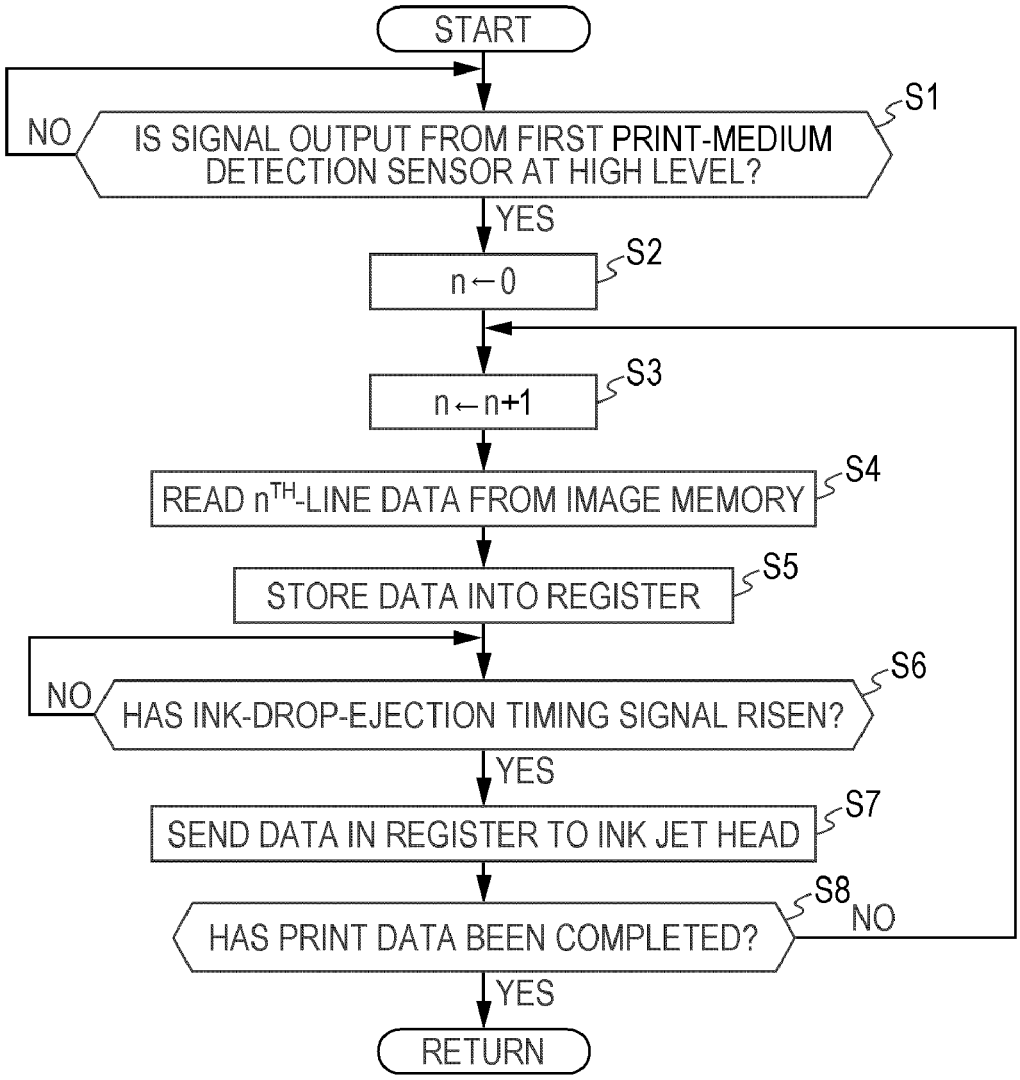
FIG. 3 is a flowchart for the process of operation executed in the control section to print on a print medium.
Figure 4:
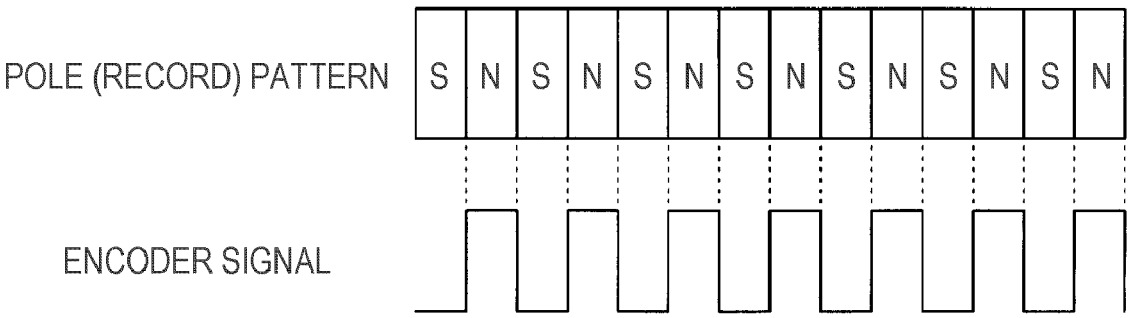
FIG. 4 is an explanatory diagram of a magnetic pole pattern recorded on the magnetic layer of a linear encoder belt and an encoder signal.

FIG. 3 shows the process of operation executed in the control section 62 for ejecting ink drops from the ink jet heads 2 and 3 to print on the print medium 1. This operation is executed every time one print medium 1 is transported to the printing region. First in step S1, it is determined whether the signal output from the first print-medium detection sensor 26 is at high level, that is, whether the print medium 1 is present directly on the first ink jet heads 2 in the direction of transportation. If the signal output from the first print-medium detection sensor 26 is at high level, the process moves to step S2; otherwise, the control section 62 comes into standby mode.

In step S2, line number n is cleared to zero.

The process then moves to step S3, wherein line number n is incremented.

The process moves to step S4, wherein the driving-signal selection data signal SI & SP of line number n is read from the image memory in the RAM 62*c* of the control section 62.

The process moves to step S5, wherein the driving-signal selection data signal SI & SP is stored in a register.

The process moves to step S6, wherein it is determined whether a rise of the pulse ink-drop-ejection timing signal has been detected. If a rise of the ink-drop-ejection timing signal has been detected, the process moves to step S7; otherwise, the control section 62 comes into standby mode.

In step S7, the driving-signal selection data signal SI & SP in the register is sent to the ink jet heads 2 and 3.

The process moves to step S8, wherein it is determined whether the print data has been completed. If the print data has been completed, the process returns to the main program; otherwise, the process moves to step S3.

According to this operation, when the first print-medium detection sensor 26 detects the transportation of the print medium 1, the driving-signal selection data signal SI & SP of line number n is read in sequence from the image memory in the RAM 62*c* of the control section 62. The driving-signal selection data signals SI & SP are sent to the ink jet heads 2 and 3 in accordance with the rise of the ink-drop-ejection timing signal to thereby print all the image data.

A method for generating the above-described ink-drop-ejection timing signal will next be described. The magnetic layers 31 of the first linear encoder belt 22 and the second linear encoder belt 23 have opposite magnetic poles, S and N, recorded (polarized) alternately at a regular pitch equal to one half of the resolution of the print image. For example, the first linear encoder sensor 24 and the second linear encoder sensor 25, which are magnetic sensors, output a pulse signal that comes to high level when the magnetic polarity recorded on the magnetic layer 31 of the linear encoder belts 22 and 23 is N, and comes to low level when the magnetic polarity is S. Accordingly, if ink drops are ejected from the ink jet heads 2 and 3 using the signals output from the first linear encoder sensor 24 and the second linear encoder sensor 25 as ink-drop-ejection timing signals, for example, on the rising edge of the output signals, a print image with a predetermined resolution can be provided. Therefore, as shown in FIG. 2, this embodiment has a selector switch 28 between the first and second linear encoder sensors 24 and 25 and the control section 62, with which the signal output from the first linear encoder sensor 24 and the signal output from the second linear encoder sensor 25 are switched to thereby output an ink-drop-ejection timing signal. The selector switch 28 may not necessarily be hardware; the signals may be switched in the control section 62, for example.

Figure 5A:
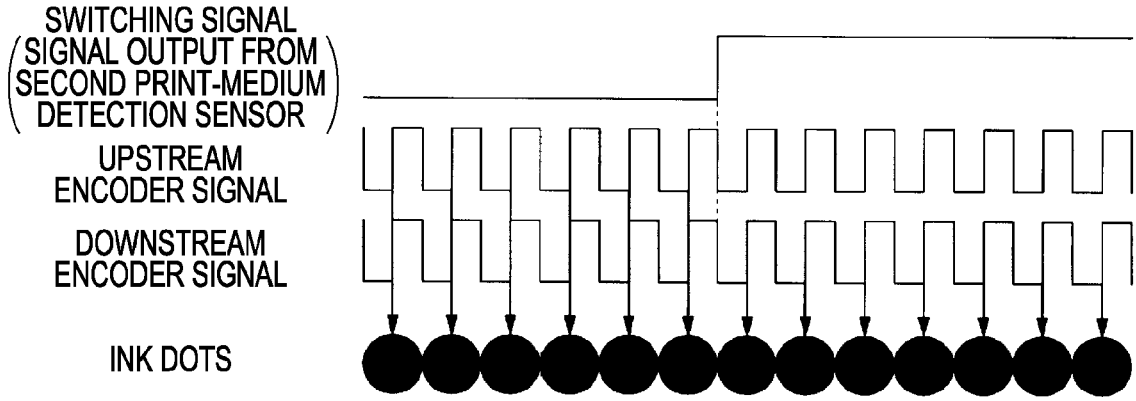
FIG. 5A is an explanatory diagram of the relationship between the switching from an upstream encoder signal to a downstream encoder signal and ink dots.
Figure 5B:
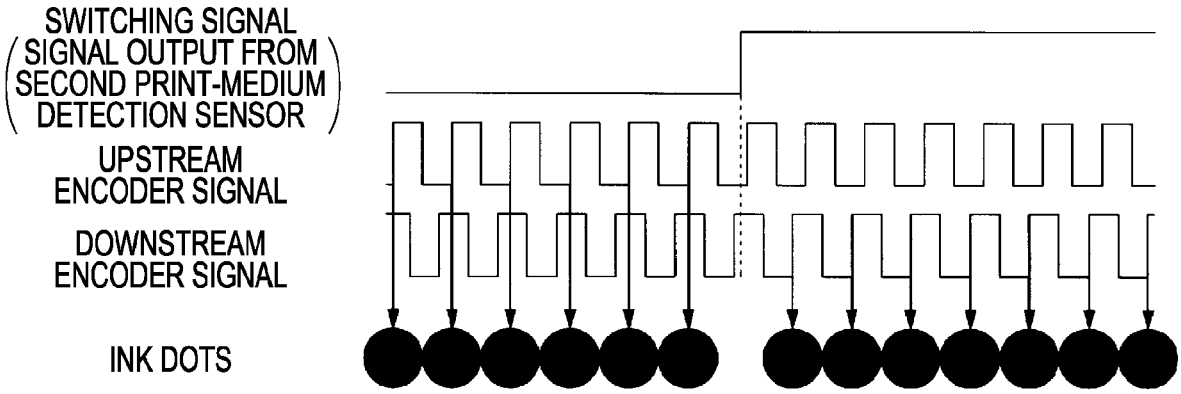
FIG. 5B is an explanatory diagram of the relationship between the switching from an upstream encoder signal to a downstream encoder signal and ink dots.
Figure 5C:
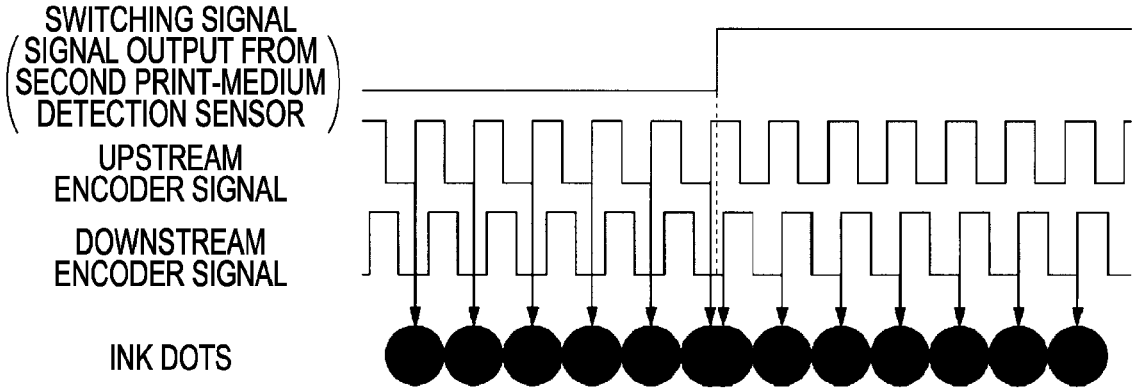
FIG. 5C is an explanatory diagram of the relationship between the switching from an upstream encoder signal to a downstream encoder signal and ink dots.

On the other hand, changes in the moving speed of the first linear encoder belt 22 and the second linear encoder belt 23 cannot be avoided. The phase difference between the signal output from the first linear encoder sensor 24 (hereinafter, also referred to as an upstream encoder signal) and the signal output from the second linear encoder sensor 25 (hereinafter, also referred to as a downstream encoder signal) cannot also be avoided. For example, FIGS. 5A to 5C show a case in which the signal output from the second print-medium detection sensor 27 is used as a switching signal to switch from the upstream encoder signal to the downstream encoder signal on the rising edge of the signal output from the second print-medium detection sensor 27 so that an ink-drop-ejection timing signal is output. As shown in FIG. 5A, in the case where there is no phase difference between the upstream encoder signal and the downstream encoder signal, that is, they are in synchronism with each other, no displacement is generated among the ink dots formed on the print medium even if the encoder signals are switched.

However, as shown in FIG. 5B, in the case where the phase of the downstream encoder signal leads that of the upstream encoder signal, if the upstream encoder signal is switched to the downstream encoder signal on the rising edge of the signal output from the second print-medium detection sensor 27 and an ink-drop-ejection timing signal is output, a rising edge of the downstream encoder signal is passed at the switching, so that ink drops are delayed to generate a gap. In contrast, as shown in FIG. 5C, in the case where the phase of the downstream encoder signal lags behind that of the upstream encoder signal, if the upstream encoder signal is switched to the downstream encoder signal on the rising edge of the signal output from the second print-medium detection sensor 27 and an ink-drop-ejection timing signal is output, the downstream encoder signal rises directly after the switching, so that the ink dots are displaced forward to cause overlap thereof. With line-head ink jet printers, such a gap or an overlap between ink dots continues in the direction intersecting the direction of transportation of a print medium, which results in a significant decrease in print quality.

Accordingly, this embodiment is configured such that, after the signal output from the second print-medium detection sensor 27 rises to high level, a switching signal different from this output signal from the second print-medium detection sensor 27 is output, according to which switching from the upstream encoder signal to the downstream encoder signal is performed. This switching signal rises to high level when the phase difference between the upstream encoder signal and the downstream encoder signal becomes a predetermined value ta or less, at which time the upstream encoder signal is switched to the downstream encoder signal. The predetermined value ta of the phase difference is increased by an adjustment value t1 every time a predetermined time Tm passes after the signal output from the second print-medium detection sensor 27 comes to high level.

Figure 6:
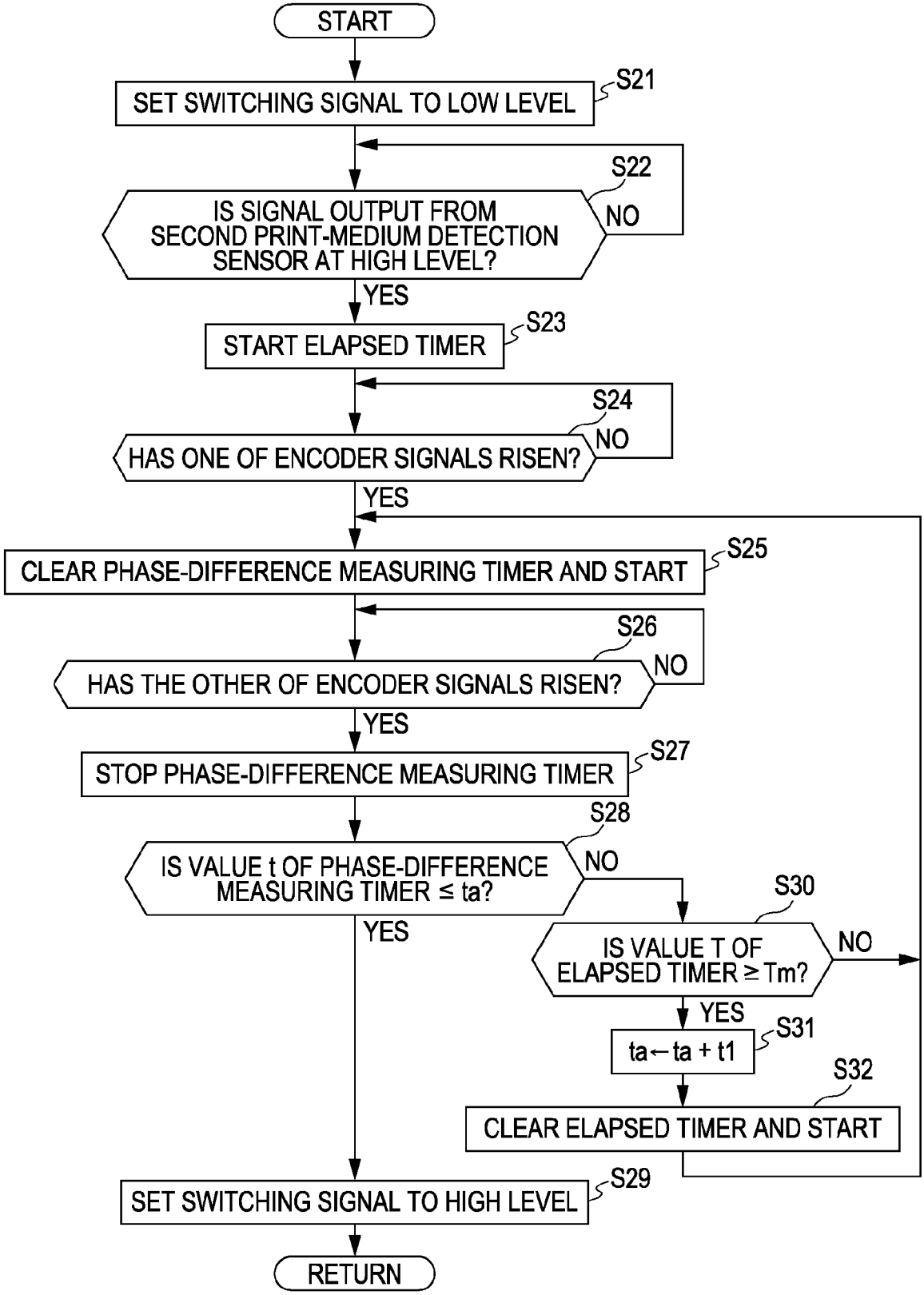
FIG. 6 is a flowchart for the operation executed in the control section to output a switching signal.

FIG. 6 shows the operation performed in the control section 62 to output the switching signal. This operation is performed every time one print medium 1 is transported to the printing region. First, in step S21, the switching signal is set to low level.

The process then moves to step S22, wherein it is determined whether the signal output from the second print-medium detection sensor 27 is at high level. If the output signal from the second print-medium detection sensor 27 is at high level, the process moves to step S23; otherwise, the control section 62 comes into standby mode.

In step S23, an elapsed timer is started.

The process then moves to step S24, wherein it is determined whether a rise of one of the upstream and the downstream encoder signals has been detected. If a rise of one of the encoder signals is detected, the process moves to step S25; otherwise, the control section 62 comes into standby mode.

In step S25, a phase-difference measuring timer is cleared and then started.

The process then moves to step S26, wherein it is determined whether a rise of the other of the upstream and the downstream encoder signals has been detected. If a rise of the other of the encoder signals is detected, the process moves to step S27; otherwise, the control section 62 comes into standby mode.

In step S27, the phase-difference measuring timer is stopped.

The process then moves to step S28, wherein it is determined whether the value t of the phase-difference measuring timer is the predetermined value ta or less. If the value t of the phase-difference measuring timer is the predetermined value ta or less, the process moves to step S29; otherwise, the process moves to step S30.

In step S29, the switching signal is set to high level.

On the other hand, in step S30, it is determined whether the value T of the elapsed timer is the predetermined time Tm or more. If the value T of the elapsed timer is the predetermined time Tm or more, the process moves to step S31; otherwise, the process moves to step S25.

In step S31, the adjustment value t1 is added to the predetermined value ta to set a new predetermined value ta, and then the process moves to step S32.

In step S32, the elapsed timer is cleared and then started, and the process moves to step S25.

Figure 7:
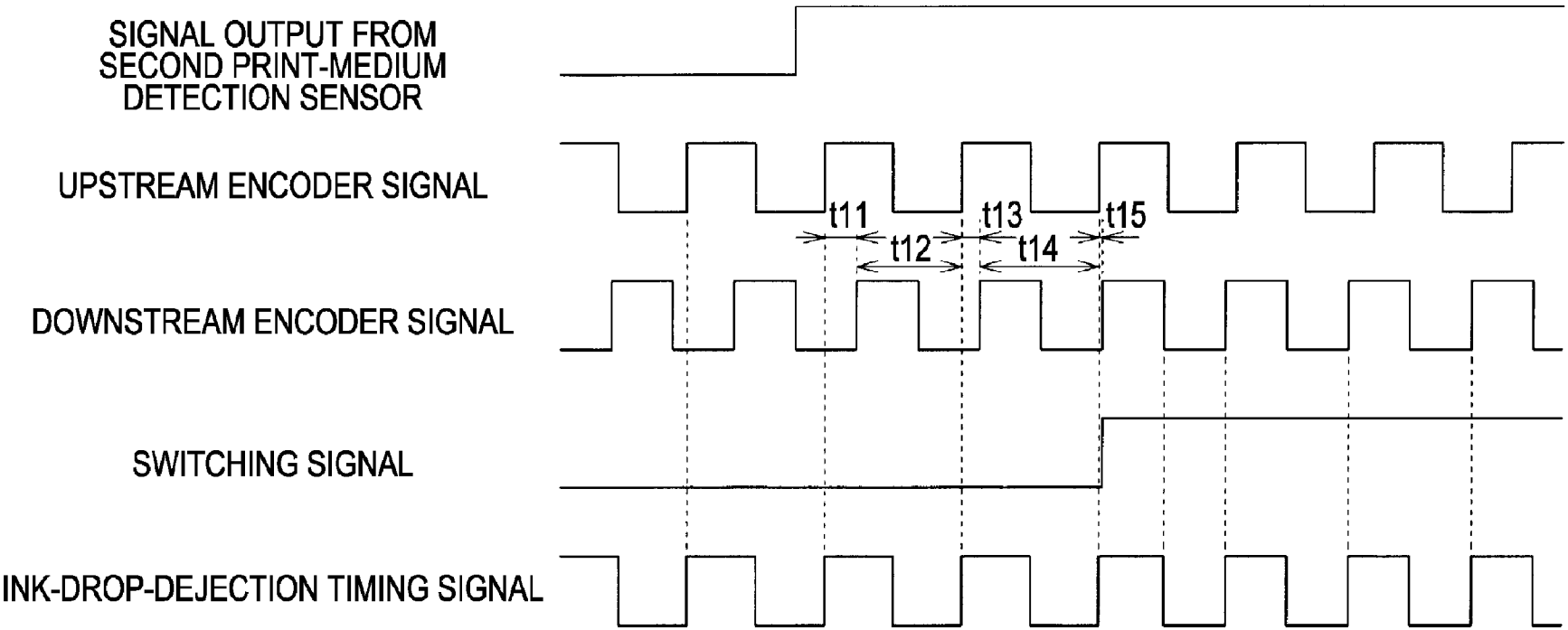
FIG. 7 is an explanatory diagram of the action of the operation of FIG. 6.

FIG. 7 illustrates the switching signal and the ink-drop-ejection timing signal in the operation of FIG. 6. Here, times t11 to t15 between the rising edges of the upstream encoder signal and the downstream encoder signal are measured by the phase-difference measuring timer after the output signal from the second print-medium detection sensor 27 rises. In this case, time t15 is smaller than the predetermined value ta. Therefore, the switching signal rises to high level after the time t15, and at that point in time, the upstream encoder signal is switched to the downstream encoder signal.

Figure 8:
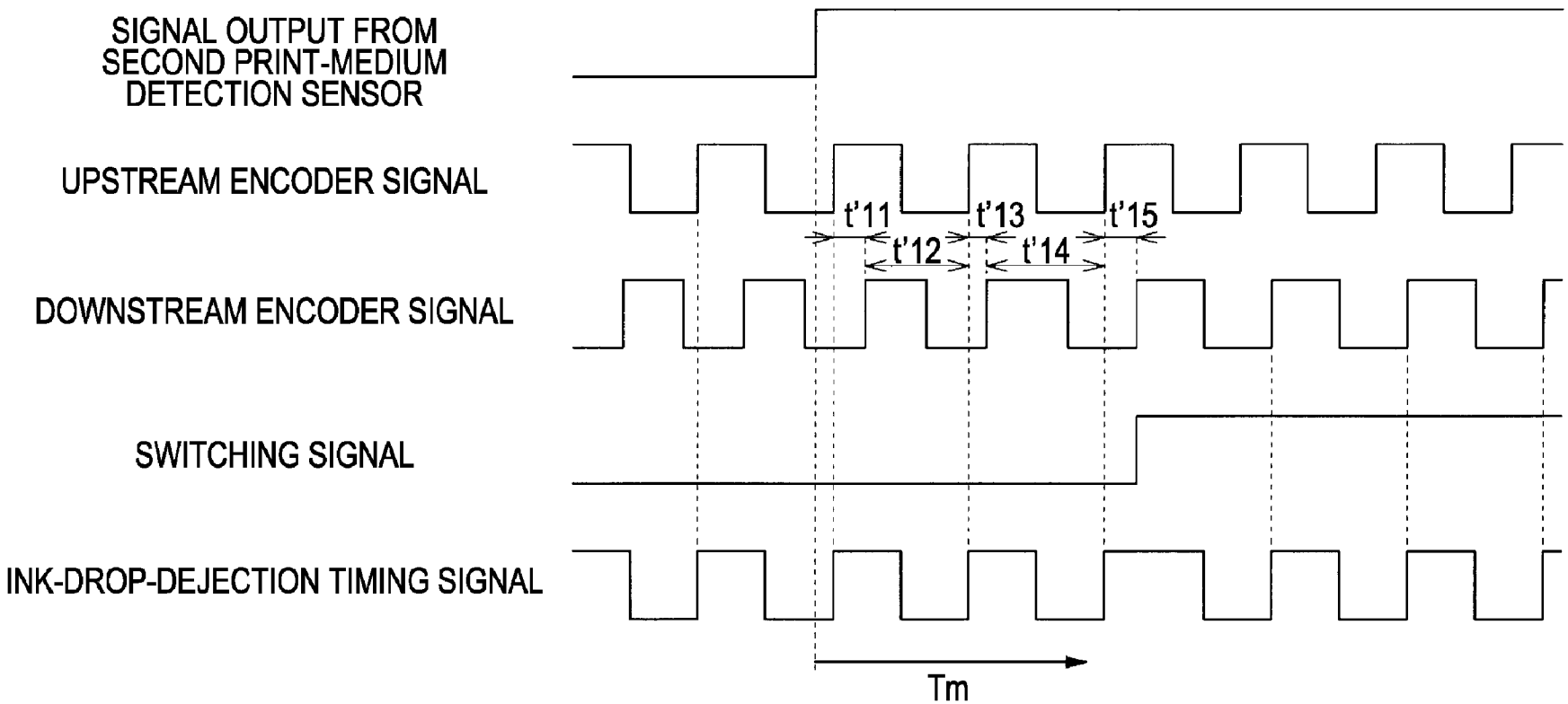
FIG. 8 is an explanatory diagram of the action of the operation of FIG. 6.

FIG. 8 also illustrates the switching signal and the ink-drop-ejection timing signal in the operation of FIG. 6. In this example, times t'11 to t'15 between the rising edges of the upstream encoder signal and the downstream encoder signal are measured by the phase-difference measuring timer after the output signal from the second print-medium detection sensor 27 rises. In this case, the predetermined time Tm passes before the time t'15 is measured. As a result, the sum of the predetermined value ta and the adjustment value t1 is set as a new predetermined value ta. Since the time t'15 is smaller than this new predetermined value ta, the switching signal rises to high level, and at that point in time the upstream encoder signal is switched to the downstream encoder signal.

In this way, when the print medium 1 is transported to a designated position of the downstream transporting unit, that is, the second transporting section 5, and when the phase difference between the upstream encoder signal and the downstream encoder signal is smaller than the predetermined value ta, the ink jet printer of this embodiment switches from the upstream encoder signal to the downstream encoder signal, and the ink-drop-ejection timing signal is output. This can decrease the displacement of the ink dots during the switching of the linear encoders, thus providing high-quality print images.

Moreover, since the predetermined value ta of the phase difference between the linear encoder signals is increased after a predetermined time Tm has elapsed from the time where the print medium 1 is transported to a designated position of the downstream transporting unit, that is, the second transporting section 5, the predetermined value ta of the phase difference between the linear encoders can be held small until the predetermined time Tm passes. This decreases the displacement of the ink dots during the switching of the linear encoders as much as possible, thus providing high-quality print images.

What is claimed is:

1. A printer comprising:

a first transporting belt that transports a print medium;

a second transporting belt that receives the print medium from the first transporting belt and further transports the print medium;

a first linear encoder that outputs a first signal corresponding to the travel of the first transporting belt;

a second linear encoder that outputs a second signal corresponding to the travel of the second transporting belt;

a liquid ejection head that ejects liquid according to a liquid-ejection timing signal to the print medium transported by the first transporting belt and the second transporting belt; and a signal generator that outputs the liquid-ejection timing signal according to one of the first signal and the second signal, wherein when the phase difference between the first signal and the second signal is a predetermined threshold value or less in transferring the print medium from the first transporting belt to the second transporting belt, the signal generator switches from outputting the liquid-ejection timing signal according to the first signal to outputting the liquid-ejection timing signal according to the second signal.

2. The printer according to claim 1, wherein when the phase difference between the first signal and the second signal is larger than the predetermined threshold value after a predetermined period of time has elapsed from the time where the print medium is transported to a designated position of the second transporting belt, the signal generator increases the predetermined threshold value.

* * * * *